US007810258B2

(12) United States Patent
Narajowski et al.

(10) Patent No.: US 7,810,258 B2
(45) Date of Patent: Oct. 12, 2010

(54) BOOT ARTICULATION SUPPORT SYSTEM

(75) Inventors: David Narajowski, Park City, UT (US); Jacob Hall, Draper, UT (US); Paul Terry, Park City, UT (US); Thomas Laasko, Park City, UT (US); Chad Whittaker, Salt Lake City, UT (US); Jeremy Saxton, Draper, UT (US); David Mellon, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 738 days.

(21) Appl. No.: 11/744,302

(22) Filed: May 4, 2007

(65) Prior Publication Data

US 2008/0271345 A1 Nov. 6, 2008

Related U.S. Application Data

(60) Provisional application No. 60/746,578, filed on May 5, 2006.

(51) Int. Cl.
*A43B 5/04* (2006.01)

(52) U.S. Cl. ..... 36/117.2

(58) Field of Classification Search ..... 36/117.2, 36/117.1, 102

See application file for complete search history.

(56) References Cited

U.S. PATENT DOCUMENTS 3,775,866 A * 12/1973 Marker ..... 36/117.2
4,505,056 A * 3/1985 Beneteau ..... 36/117.2
4,677,769 A * 7/1987 Ahmad et al. ..... 36/117.2
4,839,972 A * 6/1989 Pack et al. ..... 36/117.2
4,920,665 A * 5/1990 Pack et al. ..... 36/117.2
6,247,252 B1 * 6/2001 Parisotto ..... 36/118.7
6,665,960 B2 * 12/2003 Parisotto ..... 36/117.2
6,708,425 B2 * 3/2004 Parisotto ..... 36/118.2
2006/0225306 A1 * 10/2006 Rigat ..... 36/117.2
2008/0271345 A1 * 11/2008 Narajowski et al. ..... 36/118.2
2009/0277045 A1 * 11/2009 Sartor et al. ..... 36/117.2

* cited by examiner

*Primary Examiner*—Ted Kavanaugh
(74) *Attorney, Agent, or Firm*—Trent H. Baker; Baker & Associates PLLC

(57) ABSTRACT

The present invention relates to a support system for use in relation to an articulation region of a boot. Embodiments of the present invention relate to a boot with a dorsal metatarsal articulation region that allows for articulation in the sagittal plane such as a telemark ski boot. One embodiment of the present invention relates to a telemark ski boot, including a shell, an articulation region, and an articulation support system. The articulation support system includes at least one tensile rigid region extending transversely between the proximal and distal sides of the articulation region. The tensile rigid region impedes rotation of the rear portion of the shell about the toe portion in a frontal plane. This form of rotation is often referred to as torsional rotation. The articulation support system may include one or more of a cable, an integrated shell portion, a material mesh, and/or other tensile rigid components which maintain bending flexibility. A second embodiment of the present invention relates to a method for increasing the torsional support characteristic of a telemark ski boot while maintaining the desired flexibility.

6 Claims, 6 Drawing Sheets

BOOT ARTICULATION SUPPORT SYSTEM

RELATED APPLICATIONS

This application claims priority to U.S. provisional application Ser. No. 60/746,578 filed May 5, 2006, the contents of which are incorporated by reference.

FIELD OF THE INVENTION

The invention generally relates to a ski boot articulation system. In particular, the invention relates to a support system for use in relation to an articulation region of a boot.

BACKGROUND OF THE INVENTION

Boots are a type of footwear that encase both the foot and a portion of the lower leg of a user. Boots are generally manufactured for a particular purpose or activity and are therefore designed to include characteristics consistent with the intended purpose. For example, a hiking boot is designed to support the ankle of a user while minimizing the overall weight. Likewise, a ski boot is designed to maximize a user's performance at a particular skiing activity.

Boots generally include a shell, a compression system, and a sole. The shell and compression system operate to encase and support the foot and lower leg of a user. Various well-known shell and compression systems are utilized to allow users to insert and remove their foot in an open boot configuration and compress the shell around the foot in a closed boot configuration. The sole of a boot is disposed on the bottom surface of the shell. The sole is generally composed of a rubber or plastic material. The sole may be composed of a single piece or multiple blocks.

The general activity of skiing includes many subset activities, including but not limited to alpine touring, telemark, and downhill. Each subset of skiing generally corresponds to a unique system of specialized equipment. For example, the boot, ski, and binding systems used for telemark skiing are significantly different from those used for alpine touring. A skiing system may include standard types of boots, skis, and bindings. Each type of skiing also corresponds to unique boot characteristics for optimal performance. In addition, particular terrain and skier preference may require an even more specific set of performance characteristics. Boots for particular skiing activities must be compatible with the remainder of the system. For example, telemark skiing boots have generally been required to conform to the 75 mm standard to allow for compatibility with telemark-type bindings. In addition, telemark boots include an articulation region proximal to the dorsal metatarsal region of the foot. This articulation region allows skiers to pivot or articulate a rear portion of their boot about a front portion fixed to a ski. However, to maximize telemark performance in the remainder of the boot, it must be composed of a substantially rigid and lightweight material. Therefore, modern telemark boots generally include a bellows region and are composed of plastic composite materials. The bellows region is an opening in the rigid material that allows for articulation. The bellows region is often covered to prevent debris and snow from entering the internal region of the boot.

One of the problems with existing bellow regions relates to torsional stability. By including an opening in a rigid boot shell across the dorsal metatarsal region of a boot, the boot is intentionally allowed to vertically pivot in the sagittal plane about that point. However, this opening also enables undesirable side to side movements in the frontal plane about the same point. The side to side movements may also be referred to as torsional movement because the movements often include a degree of rotation about the fixed frontal region of the boot while attached to the ski. A telemark boot's performance is diminished by allowing these torsional movements.

Therefore, there is a need in the industry for a boot bellows region that enables vertical pivoting in the sagittal plane while providing support in the frontal plane so as to minimize side to side movements in the frontal plane.

SUMMARY OF THE INVENTION

The present invention relates to a support system for use in relation to an articulation region of a boot. Embodiments of the present invention relate to a boot with a dorsal metatarsal articulation region that allows for articulation in the sagittal plane such as a telemark ski boot. One embodiment of the present invention relates to a telemark ski boot, including a shell, an articulation region, and an articulation support system. The articulation support system includes at least one tensile rigid region extending transversely between the proximal and distal sides of the articulation region. The tensile rigid region impedes rotation of the rear portion of the shell about the toe portion in a frontal plane. This form of rotation is often referred to as torsional rotation. The articulation support system may include one or more of a cable, an integrated shell portion, a material mesh, and/or other tensile rigid components which maintain bending flexibility. A second embodiment of the present invention relates to a method for increasing the torsional support characteristic of a telemark ski boot while maintaining the desired sagittal bending flexibility.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. The Figures presented in conjunction with this description are views of only particular—rather than complete—portions of the systems and methods of making and using the system according to the invention. In the Figures, the physical dimensions may be exaggerated for clarity.

DETAILED DESCRIPTION OF THE INVENTION

The present invention relates to a support system for use in relation to an articulation region of a boot. Embodiments of the present invention relate to a boot with a dorsal metatarsal articulation region that allows for articulation in the sagittal plane such as a telemark ski boot. One embodiment of the present invention relates to a telemark ski boot, including a shell, an articulation region, and an articulation support system. The articulation support system includes at least one tensile rigid region extending transversely between the proximal and distal sides of the articulation region. The tensile rigid region impedes rotation of the rear portion of the shell about the toe portion in a frontal plane. This form of rotation is often referred to as torsional rotation. The articulation support system may include one or more of a cable, an integrated shell portion, a material mesh, and/or other tensile rigid components which maintain bending flexibility. A second embodiment of the present invention relates to a method for increasing the torsional support characteristic of a telemark ski boot while maintaining the desired sagittal bending flexibility. Also, while embodiments of the present invention are directed at telemark ski boots, it should be known that the teachings of the present invention are applicable to other fields including but not limited to other types of boots.

The following terms are defined as follows:

Ski—any type of skiing apparatus that allows a user to translate on a snow surface including but not limited to cross country skis, alpine skis, powder skis, telemark skis, downhill skis, snowboards, splitboards, skiboards, etc.

Figure 1A:
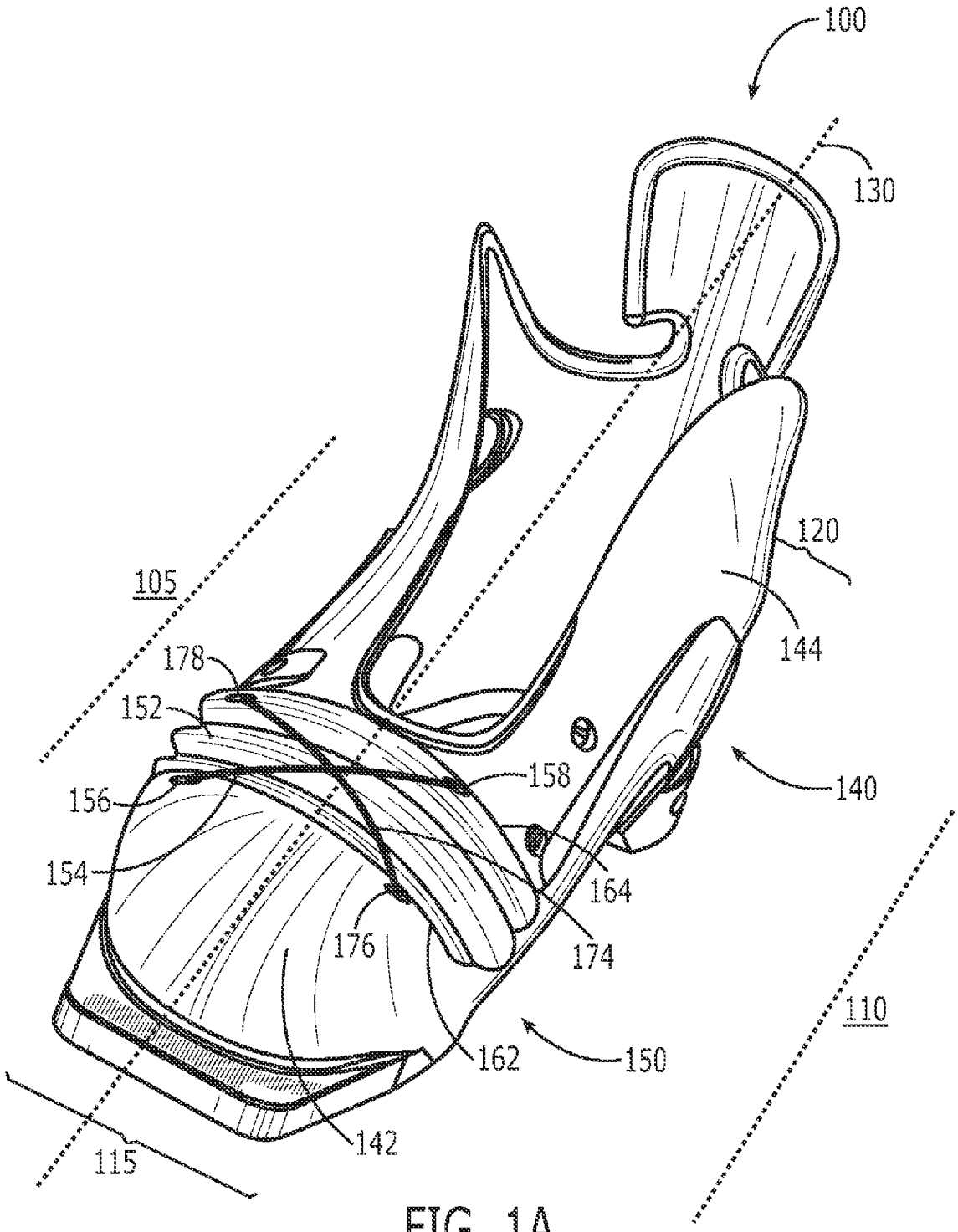
FIG. 1A illustrates perspective views of a telemark ski boot in accordance with a first embodiment of the present invention, including two flexible cables extending transversely across the articulation region in a crossed configuration so as to provide torsional support.

Sagittal plane—a substantially equidistant bisecting plane extending vertically through a ski boot along an axis parallel to that of a foot as illustrated in FIG. 1A, element 130.

Figure 1B:
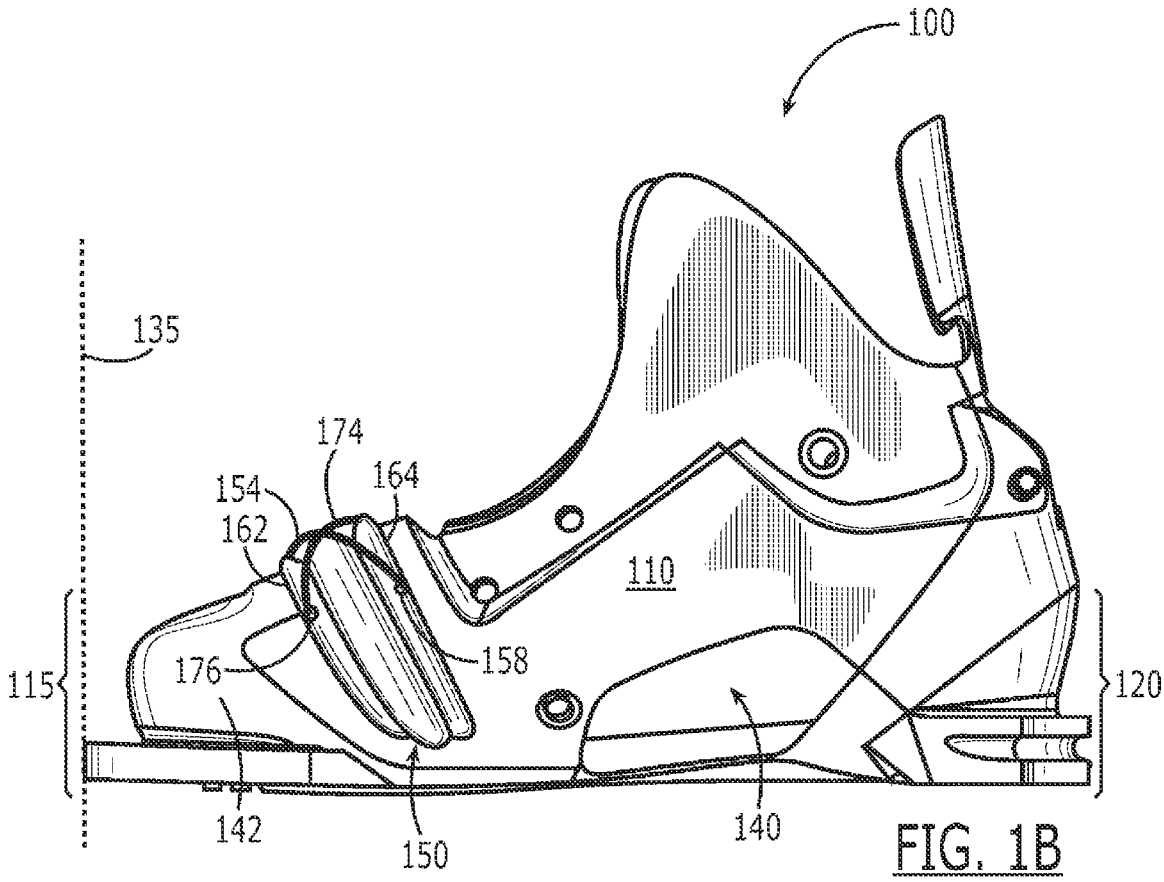
FIG. 1B illustrates a profile view of the embodiment illustrated in FIG. 1.

Frontal plane—a plane extending vertically along an axis perpendicular to that of a foot, as illustrated in FIG. 1B, element 135.

Medial—The vertical side of an object corresponding to the big toe side of a foot, as illustrated in FIG. 1A, element 110. The medial side of a ski boot is the portion of the shell region extending from the sagittal plane on the big toe side of an engaged foot.

Lateral—The vertical side of an object corresponding to the pinkie toe side of a foot, as illustrated in FIG. 1A, element 105. The lateral side of a ski boot is the shell region from the sagittal plane on the pinkie toe side of an engaged foot.

Shell—Portion of a ski boot that extends around the lower leg, ankle, and the upper and lower surfaces of a user's foot. The shell may be composed of one or more flexible lightweight plastic composite materials.

Base—a lower portion of a ski boot configured to be disposed below an engaged foot.

Articulation region—a dorsal metatarsal region of a boot that extends substantially from the medial to lateral base portion of the ski boot. For example, a boot bellows articulation region is configured to allow vertical articulation of the rear portion of a boot about a fixed toe region in the sagittal plane.

Torsion—A measure of boot support related to the lateral or rotational flexibility of a rear portion of the boot with respect to a substantially fixed toe portion.

Reference is initially made to FIGS. 1A and 1B, which illustrates a telemark ski boot in accordance with a first embodiment of the present invention, including two flexible cables extending transversely across the articulation region in a crossed configuration so as to provide torsional support, designated generally at 100. The ski boot 100 includes a shell 140, an articulation region 150, and an articulation support system. For reference purposes, a sagittal line 130, frontal plane 135, medial line 110, and lateral line 105 are illustrated. The sagittal line 130 represents a vertical sagittal plane that substantially bisects the boot 100 along an axis parallel to that of an engaged foot. The frontal plane is a vertical plane disposed in proximity to the toe portion of the boot 100. The medial line 110 and lateral line 105 illustrate the medial and lateral sides of the boot 100. The shell 140 includes one or more layers of material so as to form a shape configured to encircle a user's foot. The illustrated shell includes a toe portion 115, a dorsal toe portion 142, an ankle region 144, and a rear portion 120. The toe portion 115 refers to the entire frontal area of the shell. The rear portion 120 refers to the entire rear area of the shell. The articulation region 150 is disposed between the toe and rear portions 115, 120 of the shell in a lengthwise/sagittal location corresponding to the metatarsal bones of an engaged foot. The articulation region 150 extends across the dorsal region of the boot to enable sagittal articulation or rotation of the rear portion 120 of the boot 100 with respect to the toe portion 115. Therefore, the articulation region 150 is configured to bend or compress in response to raising the rear portion 120 of the boot 100 while the toe portion 115 is fixed. This region is also commonly referred to as the bellows on a telemark ski boot. The articulation support system refers to one or more components disposed in proximity to the articulation region configured to increase the torsional rigidity of the boot 100. Therefore, the articulation support system increases the necessary force required to rotate the rear portion 120 of the boot with respect to the toe portion 115.

The illustrated articulation region 150 includes a set of ribbed flexibility members 152 between the proximal and distal sides of the articulation region 164, 162 respectively. The ribbed flexibility members 152 are configured to enable the proximal side 164 of the articulation region 150 to bend towards the distal side 162 in response to a reasonable rotational or pivot force. The illustrated ribbed flexibility members 152 are utilized on the majority of conventional telemark ski boots for this purpose. The ribbed flexibility members 152 extend across the articulation region 150 and contain a jagged cross sectional profile, as illustrated. The flexibility members 152 may also be referred to as a flexible cover member in that it extends over the entire articulation region 150.

The articulation support system of the illustrated embodiment includes a first cable 154 and a second cable 174 extending across the articulation region 150. The first cable 154 is coupled to the proximal side 164 of the articulation region 150 via a first proximal coupling 158. The first cable is coupled to the distal side 162 of the articulation region 150 via a first distal coupling 156. Likewise, the second cable 174 is proximally coupled via a second proximal coupling 178 and distally coupled via a second distal coupling 176. The first and second cable 154, 174 may be composed of materials that include both bending flexible and tensile rigid characteristics.

Acceptable materials include but are not limited to string, cord, wire, rope, metal, straps, etc. The couplings 156, 176, 158, 178 are a fixed coupling configured to attach an end of the corresponding cable to the shell 140. The couplings 156, 176, 158, 178 may include but are not limited rivets, recesses, holes, staples, pre-molded engagement, etc. The first and second cables 154, 174 are oriented in an X-pattern so as to be substantially orthogonal to one another. Improvement in individual torsional rigidity at the articulation region 150 is achieved by adding a tensile rigid region extending at a 45 degree angle from the sagittal plane across the articulation region 150. Therefore, to increase torsion rigidity in both clockwise and counter-clockwise directions, it is necessary to create two tensile rigid regions oriented to accommodate each of the rotational directions. In the illustrated embodiment, the first cable 154 impedes (increases torsional rigidity) the rear portion 120 from rotating counter-clockwise (medially 110) with respect to the toe portion 115. Likewise, the second cable 174 impedes the rear portion 120 from rotating clockwise (laterally 105) with respect to the toe portion 115. Therefore, the first cable 154 creates a first tensile rigid region at an angle substantially 45 degrees clockwise from the sagittal plane 130; and the second cable 174 creates a second tensile rigid region at an angle substantially 45 degrees counter-clockwise from the sagittal plane 130. In addition, the substantial orthogonal positioning of the first and second cable 154, 174 create a balanced sagittal support characteristic that produces the additional benefit increasing support against direct sagittal expansion of the articulation region 150. It will be appreciated that a non-illustrated embodiment consistent with the present invention would include a single cable oriented and configured so as to create a single tensile rigid region across the articulation region 150.

Figure 2A:
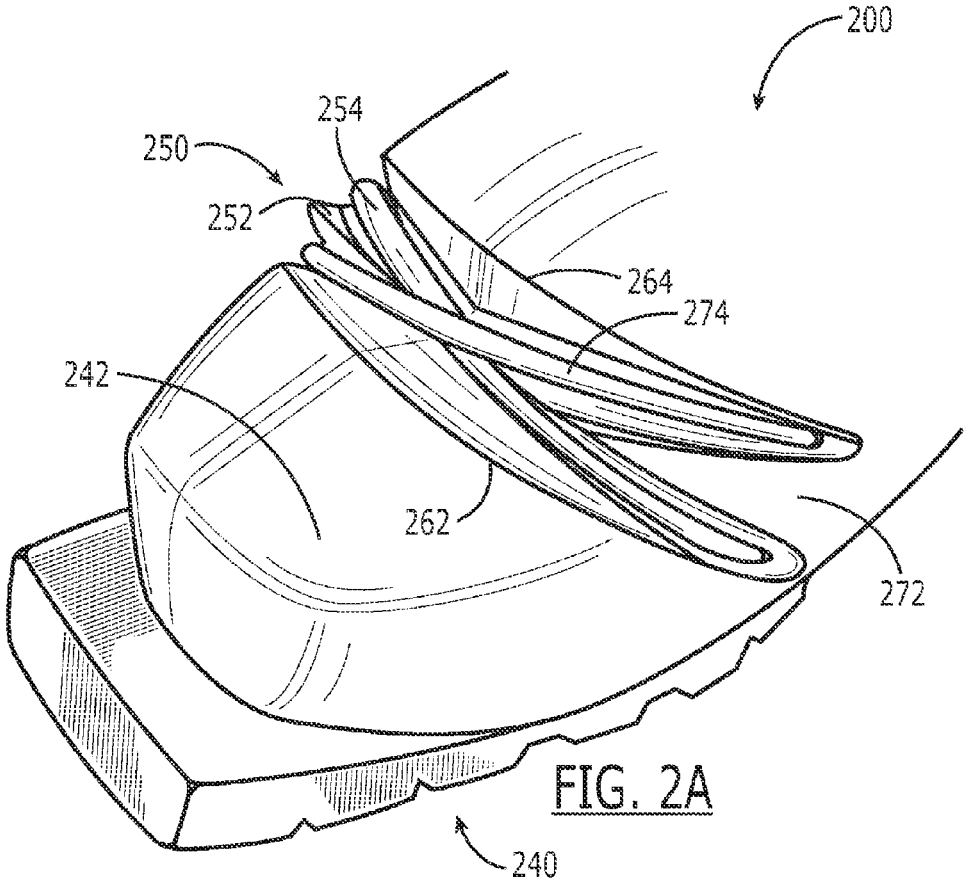
FIGS. 2A and 2B illustrate perspective views of ski boot in accordance with a second embodiments of the present invention, including integral coupled transverse flexible cables.
Figure 2B:
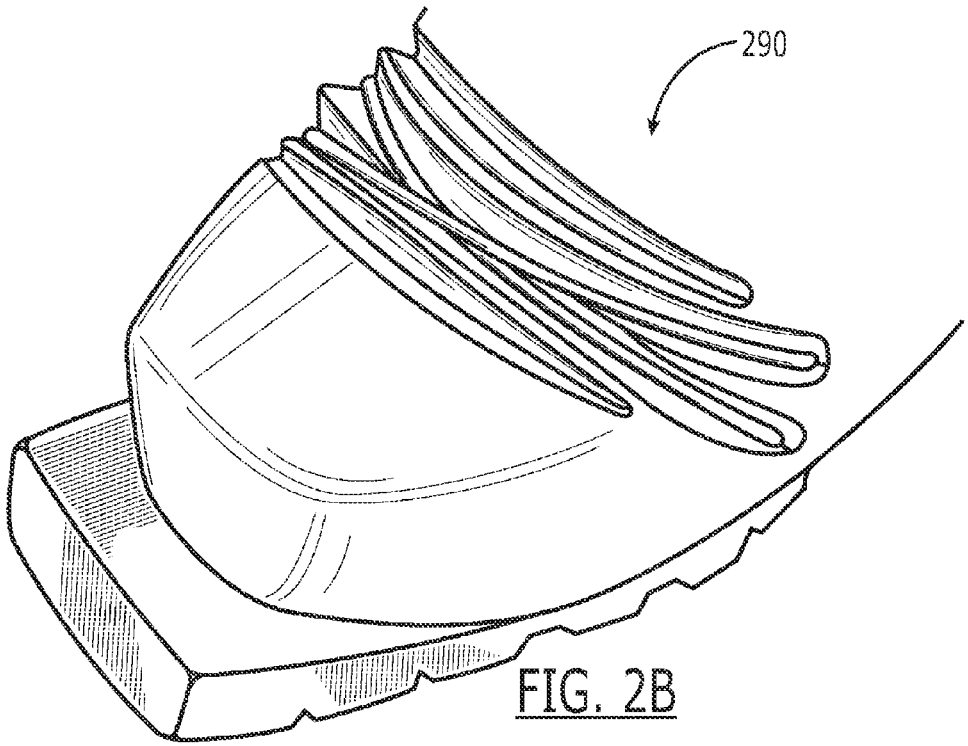

Reference is next made to FIGS. 2A and 2B, which illustrate perspective views of ski boot in accordance with a second embodiment of the present invention, including integral coupled transverse flexible cables, designated generally at 200 and 290. The illustrated ski boot 200 includes a shell 240, an articulation region 250, and an articulation support system. The shell 240 includes a dorsal toe portion 242 disposed at the toe portion (not designated) of the boot 200. The articulation region 250 includes a lateral and medial ribbed flexibility member 252, 272 oriented between the proximal and distal sides 264, 262 of the articulation region 250 so as to form an integrated X-shaped region. The articulation support system includes a first and second cable 254, 274 disposed within the integrated X-shaped region. The illustrated first and second cable 254, 274 are not orthogonal, nor are they oriented at 45 degrees from the sagittal plane. However, they still substantially increase the torsional rigidity of the articulation region while and remain within the profile of the shell 240. As discussed above, the first and second cables 254, 274 create two transverse rigid regions across the articulation region 250. The illustrated orientation and positioning of the first and second cable 254, 274 minimize the potential for hooking or snagging on an object during use. In addition, the entire articulation region 250 and articulation support system could be covered to further protect from external activity damage. FIG. 2B illustrates a slightly different boot embodiment 290, including additional flexible ribbed members. It will be appreciated that any shape of flexible ribbed members in combination with a tensile rigid region across the articulation region is consistent with the teachings of the present invention.

Figure 3:
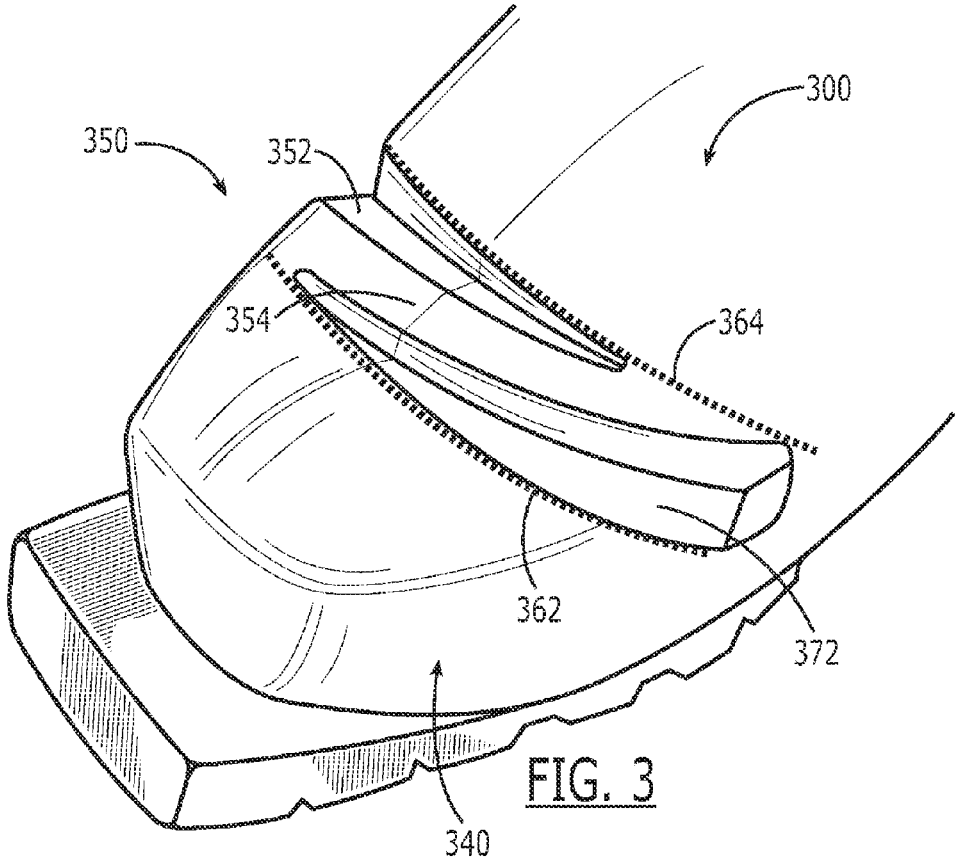
FIG. 3 illustrates a perspective view of a boot in accordance with a third embodiment of the present invention, including an integrated shell portion extending through the articulation region.

Reference is next made to FIG. 3, which illustrates a perspective view of a boot in accordance with a third embodiment of the present invention, including an integrated shell portion extending through the articulation region, designated generally at 300. The boot 300 includes a shell 340, an articulation region 350, and an articulation support system. The articulate region 350 includes lateral and medial recessed flexible regions 354, 374 transversely disposed between the proximal and distal sides 364, 364 of the articulation region 350. The articulation support system includes an integrated shell portion 354 extending transversely through the articulation region from the proximal to distal sides 364, 362. The integrated shell portion 354 forms a transverse tensile rigid region across the articulation region 350 between the lateral and medial recessed flexible regions 354, 374. The integrated shell portion 354 may be formed during the molding of the shell or may be subsequently coupled or bonded to a shell with a recessed articulation region. The lateral and medial recessed flexible regions 354, 374 may be recessed within a flexible cover member or may be differently composed materials. The orientation of the illustrated integrated shell portion 354 will predominantly increase the torsional support in the medial or counter-clockwise rotational orientation. Alternatively, other shaped integrated shell portions and recessed flexible regions may be utilized to balance or adjust the torsional support characteristics. For example, the transverse angle from the sagittal plane of the integrated shell portion may be adjusted according to the size of the boot in order to specically tune the torsional support according to a user's foot size.

Figure 4:
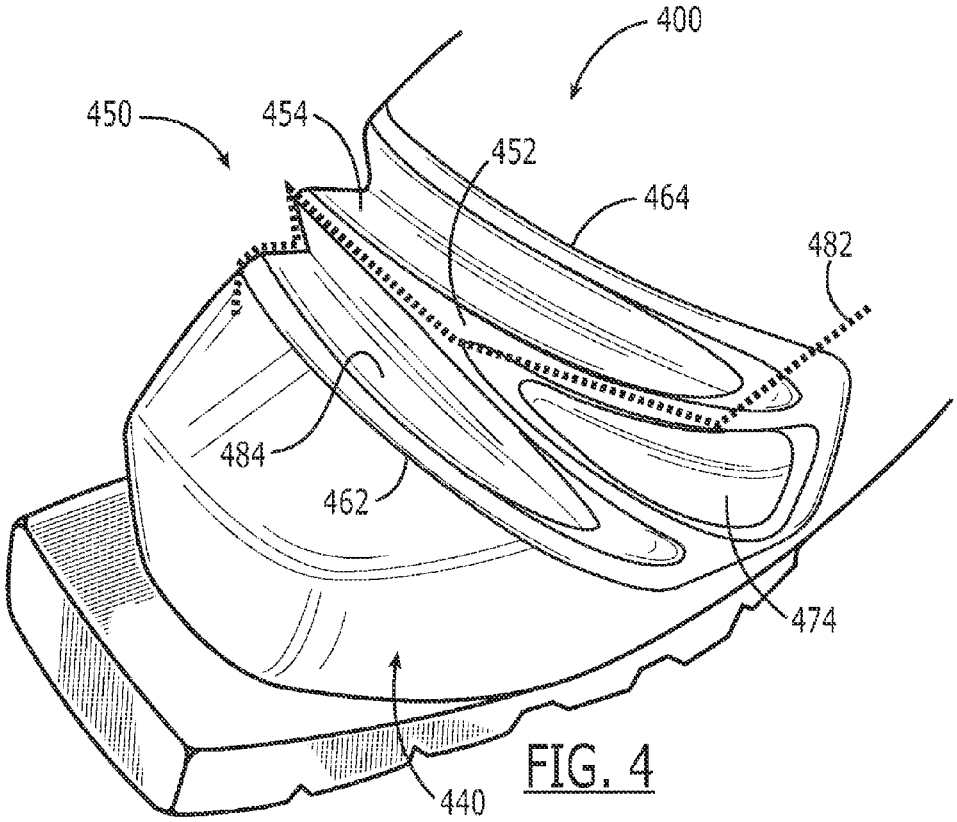
FIG. 4 illustrates a perspective view of a boot in accordance with a fourth embodiment of the present invention, including an integrated dual density shell portion extending through the articulation region.

Reference is next made to FIG. 4, which illustrates a perspective view of a boot in accordance with a fourth embodiment of the present invention, including an integrated dual density shell portion extending through the articulation region, designated generally at 400. Dual density technology includes multiple shell layers of varying compositions and may be used to form various pockets of rigid and flexible material in accordance with the present invention. The boot 400 includes a shell 440, an articulation region 450, and an articulation support system. The illustrated articulation region 450 and articulation support system include multiple flexible regions 454, 474, 484 composed of one or more lower density materials and shaped in a concave manner so as to enhance flexibility characteristics. In addition, a higher density material 452 is shaped and positioned therebetween, as illustrated. The higher density material 452 creates a non-linear transverse tensile rigid region designated at 482 extending from the proximal 464 to the distal 462 side of the articulation region 450. Various other embodiments may utilize differently shaped, positioned, composed, curved and configured regions within the articulation region so as to create at least one tensile rigid region thereby increasing torsional rigidity.

Figure 5A:
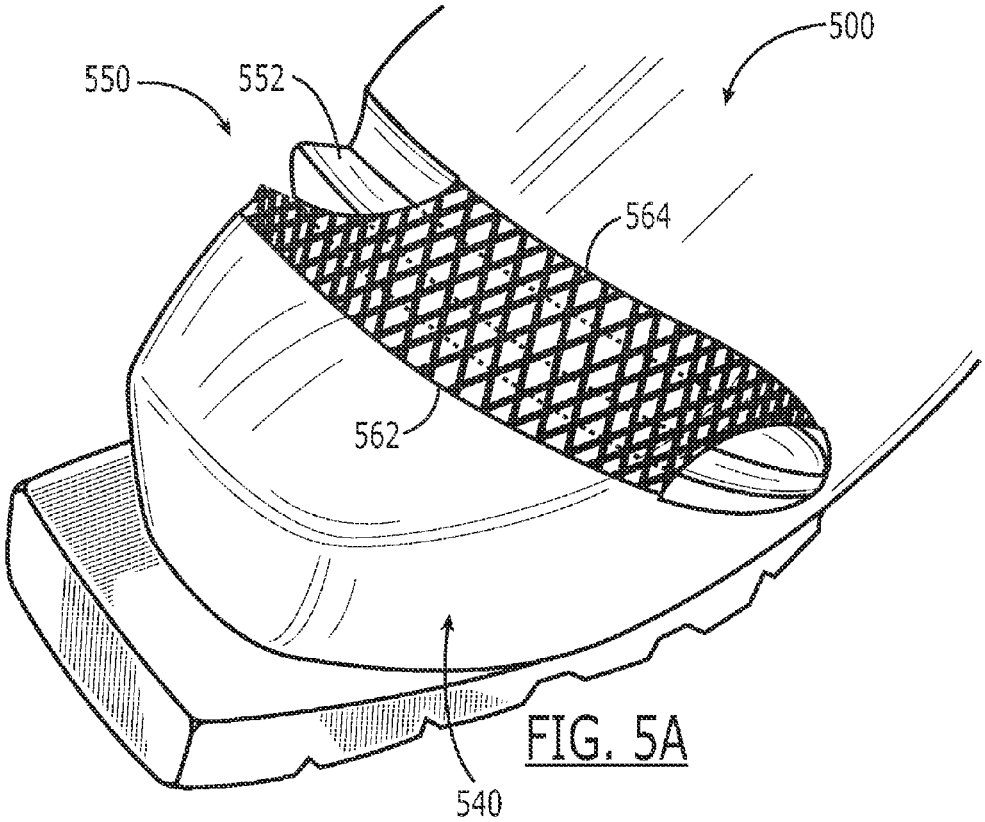
FIG. 5 illustrates perspective views of a boot in accordance with a fifth embodiment of the present invention, including a mesh material extending through the articulation region.
Figure 5B:
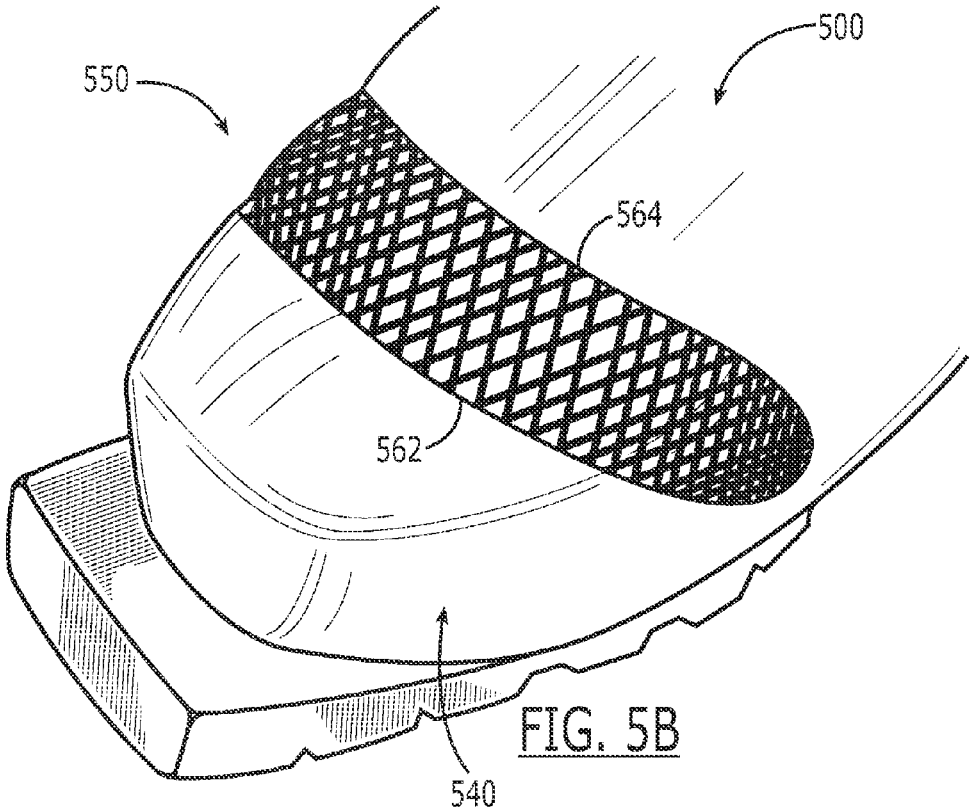

Reference is next made to FIG. 5, which illustrates perspective views of a boot in accordance with a fifth embodiment of the present invention, including a mesh material extending through the articulation region, designated generally at 500. The boot 500 includes a shell 540, an articulation region 550, and an articulation support system. The articulation region 550 includes a conventional set of ribbed flexible members 552. The articulation support system includes a material mesh 554 or mesh extending between the proximal 564 and distal 562 sides of the articulation region 550. The fibers of the mesh 554 are woven/interlaced in a conventional pattern oriented substantially orthogonal of one another. The orthogonal orientation creates an increased tensile strength of the fiber in the directions parallel to one set of fibers. The orientations of the fibers operate in a torsional manner analogous to individual cables. The mesh 554 is positioned such that the fibers are oriented at angles substantially 45 degrees from the sagittal plane of the boot 500. This orientation of the mesh 554 will therefore maximize the torsional support across the articulation region 550. Various linear and non-linear tensile rigid regions will be created along the fibers extending from the proximal 564 to the distal 562 sides of the articulation region 550. In addition, the inherent orthogonal orientation will provide support against separation of the articulation region 550. Although illustrated as covering the articulation region, the mesh 554 may also be coupled directly to the ribbed flexible members 552 directly to follow the cross-sectional jagged orientation. The mesh 554 may be retrofitted onto an existing boot's articulation region so as to increase torsional support. Various mesh materials and compositions may be used, including those with Aramid fibers.

Figure 6:
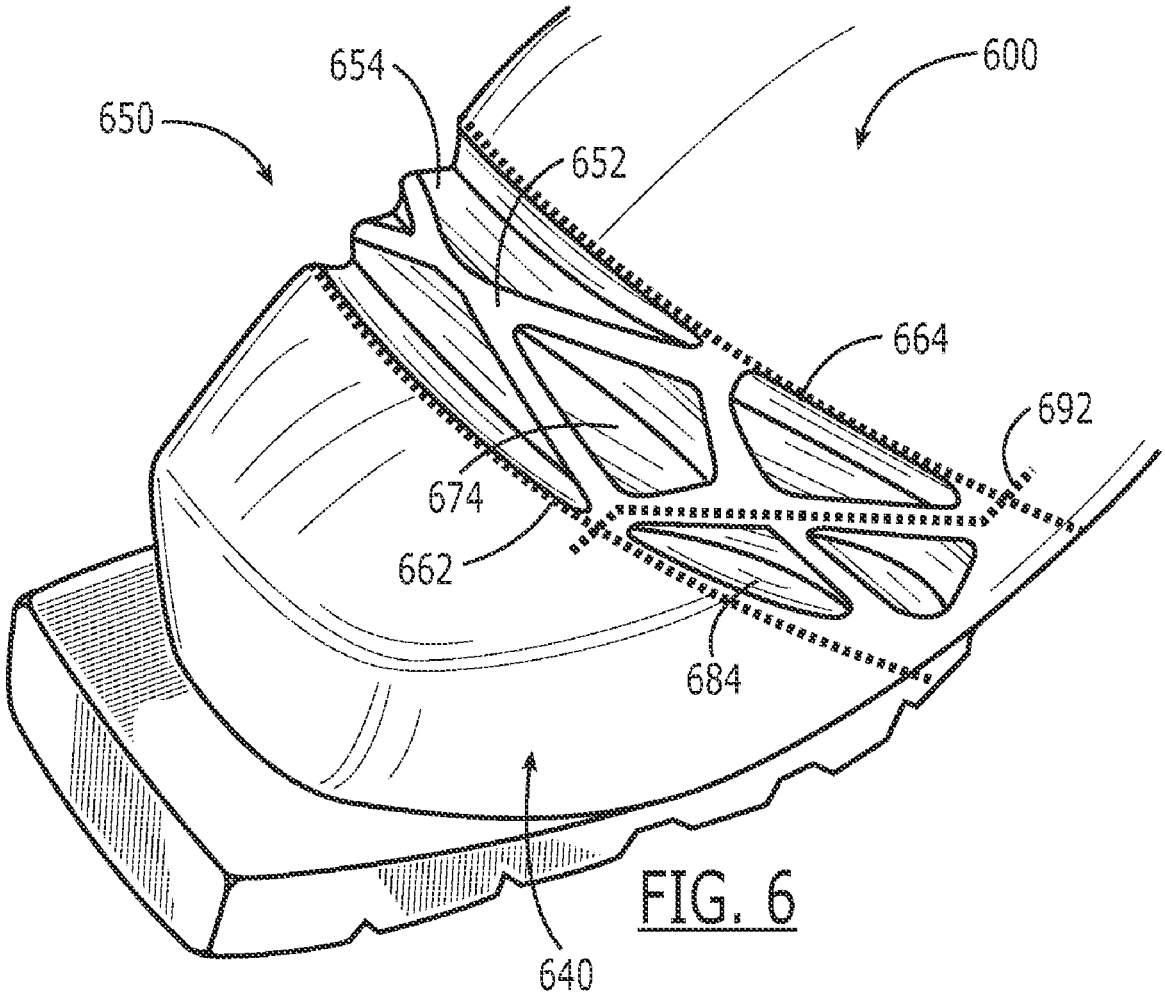
FIG. 6 illustrates a perspective view of a boot in accordance with a sixth embodiment of the present invention, including a web of integrated shell portions extending through the articulation region.

Reference is next made to FIG. 6, which illustrates a perspective view of a boot in accordance with a sixth embodiment of the present invention, including a web of integrated shell portions extending through the articulation region, designated generally at 600. The boot 600 includes a shell 640, an articulation region 650, and an articulation support system. The illustrated articulation region 650 and articulation support system include a web of flexible indented members 654, 674, 684 and an integrated shell portion 652 extending therebetween. As discussed above, the flexible indented members 654, 674, 684 may be composed of individual flexible members or may be part of an expanded lower density material that enables sufficient flexibility properties. The integrated shell portion 652 forms various non-linear transverse tensile rigid regions extending from the proximal 664 to the distal 662 side of the articulation region 650. One example of a non-linear transverse tensile rigid region is illustrated at 692. Various shapes and combinations of shell material and flexible pockets may be utilized to create specific torsional support characteristics.

Various other embodiments have been contemplated, including combinations in whole or in part of the embodiments described above.

What is claimed is:

1. A telemark ski boot comprising:

a shell configured to encase a foot and a portion of a lower leg, wherein the shell is configured to include an open configuration for inserting the foot and a closed configuration for supporting the foot with respect to the lower leg, wherein the shell includes a base configured to be disposed below the foot, a toe portion, and a rear portion;

an articulation region disposed on the shell extending dorsally from a lateral portion of the base to a medial portion of the base at a lengthwise location corresponding to the metatarsal region of the foot, wherein the articulation region enables a rear portion of the shell to articulate vertically in the sagittal plane while a toe portion of the shell is fixed; and an articulation support system including at least one tensile rigid region extending transversely from the proximal to the distal side through the articulation region thereby impeding rotation of the rear portion about the toe portion in at least one rotational direction in the frontal plane, wherein the tensile rigid region is flexible in the sagittal plane, wherein the articulation support system further includes a cable extending transversely over the articulation region and coupled to the proximal and distal sides of the articulation region so as to form a diagonal tensile rigid region.

2. The telemark ski boot of claim 1, wherein the articulation region includes:

a recess in the shell extending dorsally from a lateral portion of the base to a medial portion of the base at a lengthwise location corresponding to the metatarsal region of the foot; and a flexible cover member coupled to the recess in a manner to prevent debris from entering the recess through the articulation region.

3. The telemark ski boot of claim 1, wherein the tensile rigid region is a transverse region across the articulation region configured to exhibit substantially rigid tensile properties while maintaining flexible bending properties.

4. The telemark ski boot of claim 1, wherein the articulation support system further includes two cables extending transversely over the articulation region and coupled to the proximal and distal sides of the articulation region so as to form two diagonal tensile rigid regions, and wherein the two cables are oriented substantially perpendicular of one another.

5. A method for increasing the torsional support characteristics of a telemark ski boot comprising the acts of:

providing a telemark ski boot further including:

a shell configured to encase a foot and a portion of a lower leg, wherein the shell is configured to include an open configuration for inserting the foot and a closed configuration for supporting the foot with respect to the lower leg, wherein the shell includes a base configured to be disposed below the foot, a toe region, and a rear region;

an articulation region disposed on the shell extending dorsally from a lateral portion of the base to a medial portion of the base at a lengthwise location corresponding to the metatarsal region of the foot, wherein the articulation region enables a rear portion of the shell to articulate vertically in the sagittal plane while a toe portion of the shell is fixed; and forming a tensile rigid region extending transversely from the proximal to the distal side of the articulation region, wherein the act of forming a tensile rigid region includes coupling at least one cable transversely across the distal to proximal sides of the articulation region;

impeding rotation of the rear portion of the shell about the toe portion of the shell in at least one rotational direction in the frontal plane;

maintaining flexibility of the rear portion shell with respect to the toe portion of the shell about the articulation region in the sagittal plane.

6. The method of claim 5, wherein the act of forming a tensile rigid region includes transversely extending an integrated portion of the shell across the distal to proximal sides of the articulation region.

* * * * *